US008348061B2

(12) United States Patent
Komatsuda et al.

(10) Patent No.: US 8,348,061 B2
(45) Date of Patent: Jan. 8, 2013

(54) COSMETIC CONTAINER

(75) Inventors: Kiyoshi Komatsuda, Sumida-ku (JP); Satoru Naramoto, Sumida-ku (JP)

(73) Assignee: Hidan Co., Ltd. (JP)

( * ) Notice: Subject to any disclaimer, the term of this patent is extended or adjusted under 35 U.S.C. 154(b) by 162 days.

(21) Appl. No.: 12/845,347

(22) Filed: Jul. 28, 2010

(65) Prior Publication Data

US 2011/0073601 A1 Mar. 31, 2011

(30) Foreign Application Priority Data

Aug. 3, 2009 (JP) ..... 2009-180439

(51) Int. Cl.
*B65D 51/00* (2006.01)
*B65D 69/00* (2006.01)

(52) U.S. Cl. ..... 206/581; 220/230

(58) Field of Classification Search ..... 220/230, 220/212, 200; 206/581, 223, 216; 401/98, 401/88; 24/303; D9/436, 435; *B65D 51/00*
See application file for complete search history.

(56) References Cited

U.S. PATENT DOCUMENTS 3,150,771 A * 9/1964 Seaver ..... 401/98
4,260,180 A * 4/1981 Halushka et al. ..... 285/9.1
4,417,827 A * 11/1983 Kasai et al. ..... 401/68
5,409,275 A * 4/1995 Yoshida et al. ..... 292/251.5
6,070,725 A 6/2000 Ito et al.
6,070,749 A * 6/2000 Joulia ..... 220/4.22
2008/0258854 A1 * 10/2008 Davis ..... 335/285
2008/0264944 A1 * 10/2008 Hui ..... 220/230

FOREIGN PATENT DOCUMENTS

JP 01167055 A * 6/1989
JP 3153992 4/2001

* cited by examiner

*Primary Examiner* — Mickey Yu
*Assistant Examiner* — Robert J Hicks
(74) *Attorney, Agent, or Firm* — Gerald E. Hespos; Michael J. Porco

(57) ABSTRACT

A cosmetic container (X) has a cap (11) that is fit externally onto a container body (1), in which a cosmetic is stored, to fully cover a to-be-covered portion of the container body (1). First and second magnets (15 and 17) are disposed respectively in the cap (11) and the container body (1) so as to oppose each other in the completely covered condition and so that the cap (11) fully covers the container body (1) by the mutual magnetic attachment of the magnets (15, 17). Each magnet (15, 17) is formed into a ring in a circumferential direction and having a plurality of magnetic poles disposed alternately in the circumferential direction.

6 Claims, 15 Drawing Sheets

COSMETIC CONTAINER

BACKGROUND OF THE INVENTION

1. Field of the Invention

This disclosure relates to cosmetic containers for storing cosmetics, such as lipstick, etc.

2. Description of the Related Art

A known cosmetic container includes a cap that is fit externally to cover an upper end of a container body in which a cosmetic is stored. The container may be stowed in a case, such as a cosmetic bag, etc., with the cap in a fully covering posture. However, a load may act on the case and may cause the case to bend. Thus, the full covering by the cap is undone, and in a worst case, the cap becomes detached inadvertently from the container body.

Japanese Patent No. 3153992 discloses an arrangement to avoid the above-described problem. More particularly, Japanese Patent No. 3153992 shows a thick-walled portion formed on an inner cap and a rib formed on an outer circumferential surface of an upper end of a container body. The thick-walled portion passes over the rib when the cap fully covers the upper portion of the container body. Motion resistance is provided to prevent detachment, provide stability in the covered state, and enable recognition of the cap being in the completely covered condition.

With the above arrangement of Japanese Patent No. 3153992, the upper end of the container body becomes exposed when the cap is removed, and the rib on the outer circumferential surface of the upper end of the container body is made visibly recognizable by the exposure. This is unfavorable in terms of appearance and lacking in high-class touch because grime, etc., is readily retained at the vicinity of the rib.

The cap of Japanese Patent No. 3153992 must be pressed toward the container body until the thick-walled portion of the inner cap passes over the rib formed on the upper portion of the container body to put the cap in the completely covered condition. However, the passing over of the rib is not achieved if the pressing force is weakened in the middle. The storage state of the cosmetic degrades if the container is left in such a halfway covering posture. Additionally, the cap may be removed inadvertently thereby causing dirt to be attached to the cosmetic and causing the cosmetic to be attached on other contents of the case if the container is put in a case such as a makeup bag in this state.

To resolve the above-described problem, an arrangement may be considered where magnets are disposed respectively along entire circumferences of portions of a cap and a container body that are put in contact in a completely covered condition in such a manner that mutually different magnetic poles oppose each other. Thus, the magnets will be attached magnetically to each other and will maintain the cap in a covering posture with respect to the container body. However in this case, an entire circumference is of the same magnetic pole. Hence, position setting of the cap in a circumferential direction with respect to the container body cannot be performed in the covering posture. This arrangement cannot be employed in a container that requires such position setting (for example, in a container with which trademarks drawn respectively on the cap and the container body are to be matched with each other). A process of removing such a cap that is in the covering posture requires a strong pulling operation in a direction that opposes a direction in which magnetic lines act most strongly to sever the magnetic attractive force. Such a container generally is used by women who may have difficulty exerting the force for removal of the cap.

FIG. 15 proposes that magnets 20 and 21, with contacting portions being N and S poles, respectively, be disposed opposite each other in a mutually-spaced, dotted manner in a cap 11 and magnets 22 and 23, with contacting portions being S and N poles, respectively, be disposed in likewise manner in a container body 1. In covering with the cap 11, the N and S magnets 20 and 21 of the cap 11 and the S and N magnets 22 and 23 of the container body 1 are made to be magnetically attached to each other.

The magnets will attract each other and will enable correct covering to be achieved even if the magnets 20 and 22 and magnets 21 and 23 of mutually different poles are shifted slightly in the circumferential direction. However, the magnets of different poles may not attract each other if covering is performed with the magnets shifted a large amount in the circumferential direction. In this case, covering by magnetic attachment cannot be performed and the cap 11 is detached easily. The number of magnets may be increased to resolve this problem, but this leads to an increased number of parts and causes assembly to be troublesome and complicated.

In a case where magnets of different poles are disposed in a dotted manner, the cap is removed by turning the cap in the circumferential direction with respect to the container body to turningly sever magnetic lines in the most strongly acting directions. This enables a removal operation that is easy in comparison to the removal operation of the above-described arrangement in which a magnet of the same pole is disposed along an entire circumference. The cap cannot be removed smoothly with the arrangement where a magnet of the same pole is disposed along an entire circumference because a jolt-like response that causes an odd sensation occurs due to the magnetic lines in the most strongly acting directions being turningly severed, and herein lies the problem to be solved by the present invention.

SUMMARY OF THE INVENTION

The invention has been made for the purpose of solving the above-described problems in view of the circumstances above. A first aspect of the invention provides a cosmetic container including a tubular-bottomed body storing a cosmetic, and a tubular-topped cap externally fit in a removable manner from an upper end of the container body to fully cover a to-be-covered portion at an upper side of the container body. Magnets are disposed in the cap and the container body so that full covering is achieved by mutual magnetic attachment of the magnets. The respective magnets have a ring-like form in a circumferential direction. Plural magnetic poles are disposed alternately in the circumferential direction, and are disposed at the cap and the container body side so as to oppose each other in the completely covered condition.

The magnets disposed in the cap and the container body are attracted smoothly to each other by magnetic lines in the circumferential direction so that the cap easily can be put in the fully covering posture. The cap can be removed from the container body by simply turning the cap lightly with respect to the container body. Thus, the magnetically attached state of the magnets disposed in the cap and the container body is gradually undone and a mutual repulsive force of the same poles increases gradually as the same poles approach each other so that the cap can be removed easily. Moreover, the switching from the magnetically attached state to the repulsing state takes place gradually, and there is no jolt sensation during switching such that occurs when the switching takes place instantaneously. As a result, the cap can be removed smoothly from the container body.

The magnet of the cap preferably is disposed at a lower end of the cap, and the magnet of the container body preferably is disposed at a portion contacting the lower end of the cap in the completely covered condition. Portions of the cap and the container body that have the magnets contact and generate a collision sound when the completely covered condition is reached. Thus, a user can recognize more clearly that the completely covered condition is reached.

Each of the cap magnet and the container body magnet may have four magnetic poles. Thus, locations for alignment can be set at two locations and magnetic attachment is achieved more easily because the number of magnetic attachment locations is increased. Also, in a case where an outer shape of the cosmetic container is right/left symmetrical, the outer shape of the cosmetic container is not spoiled regardless of which of the two alignment locations alignment is performed to.

Alternatively, each of the cap magnet and the container body magnet may have two magnetic poles. Accordingly, the location for alignment can be set at one location, and in a case where the outer shape of the cosmetic container cannot be manifested properly unless alignment is performed to just one location, the outer shape can be manifested reliably by performing alignment to the one location.

Marks for aligning the magnetic poles of the magnet at the cap and the magnet at the container body preferably are formed at an outer circumferential surface of the cap and an outer circumferential surface of the container body. Thus, the cap can be aligned properly with respect to the container body. The ability to achieve a specific alignment is important for a cosmetic container that has a specific outer shape formed integrally by the cap and the container body, so that the specific outer shape can be achieved reliably.

The cap and the container body preferably have covers for covering the magnets so that the magnets are not exposed to the exterior. Accordingly, the magnets are not likely to break by hitting a foreign object, and even if breakage occurs, loss of broken pieces is prevented, and the cosmetic container can be made excellent in terms of appearance.

The cap and the container body preferably are provided with magnetic line shielding members for shielding or reducing leakage of magnetic lines to the exterior from the magnets. Accordingly, magnetic force from the cosmetic container will not leak and influence other magnetic bodies stored in a handbag, etc., and will not damage a magnetic card, etc.

DETAILED DESCRIPTION OF THE PREFERRED EMBODIMENTS

Figure 1:
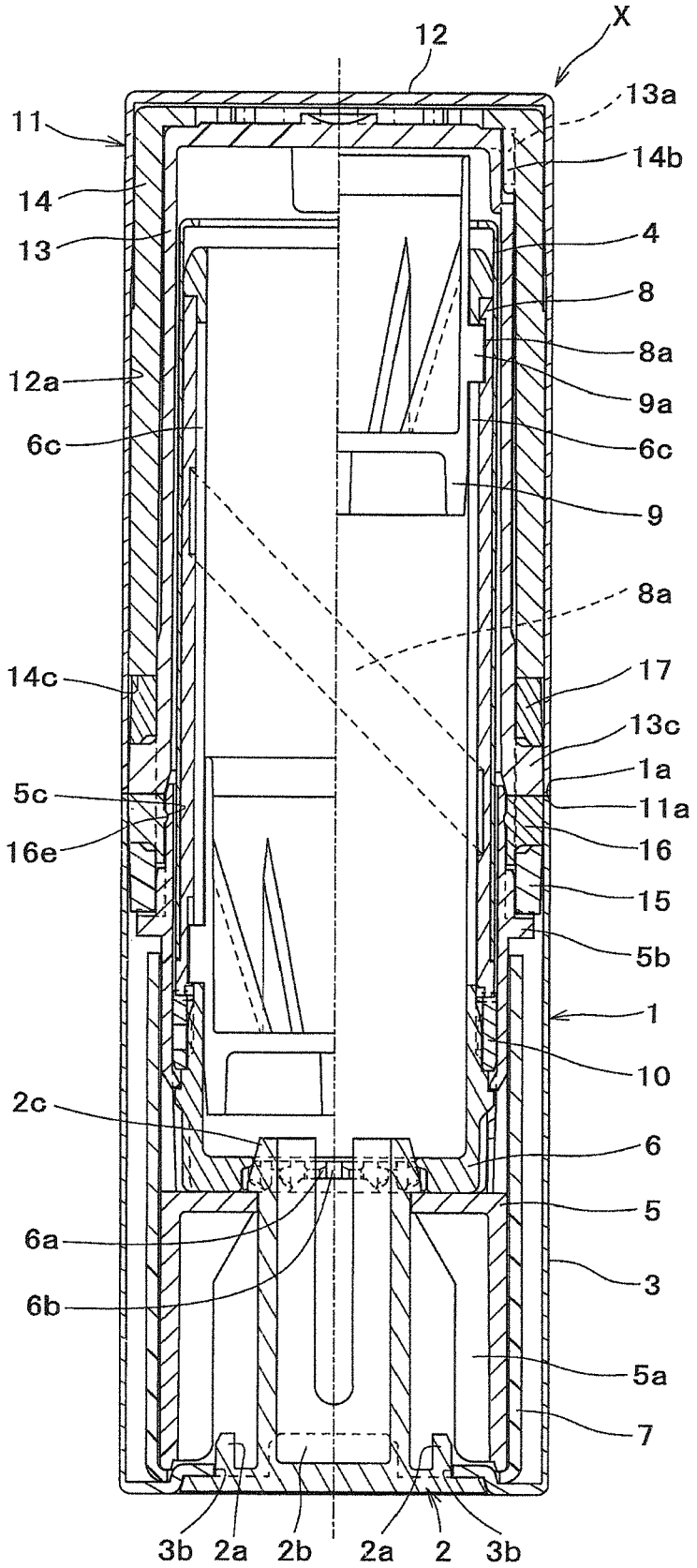
FIG. 1 is a longitudinal sectional view of a state where a container body is fully covered by a cap.
Figure 2:
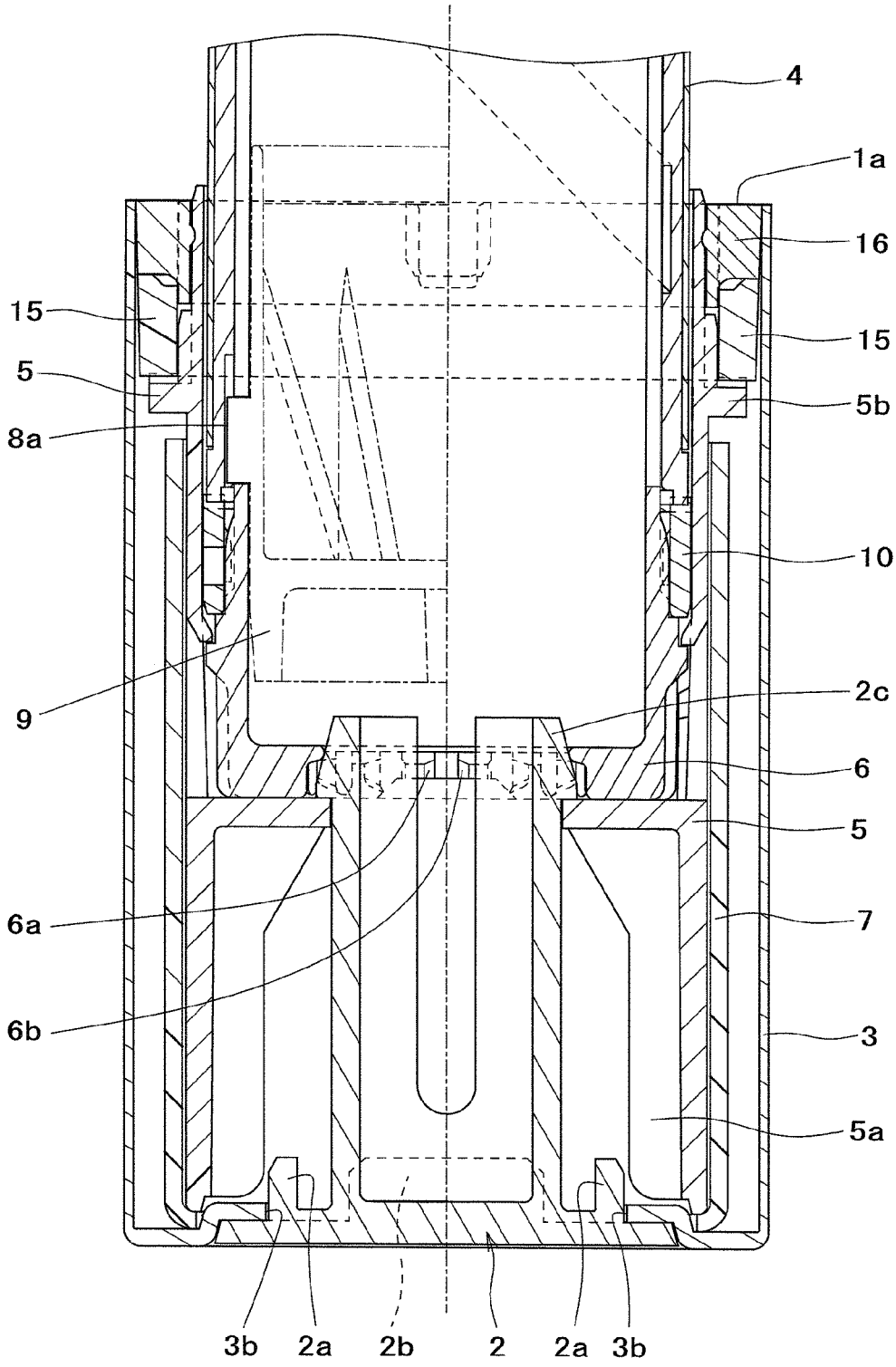
FIG. 2 is a longitudinal sectional view of principal portions of the container body.
Figure 3:
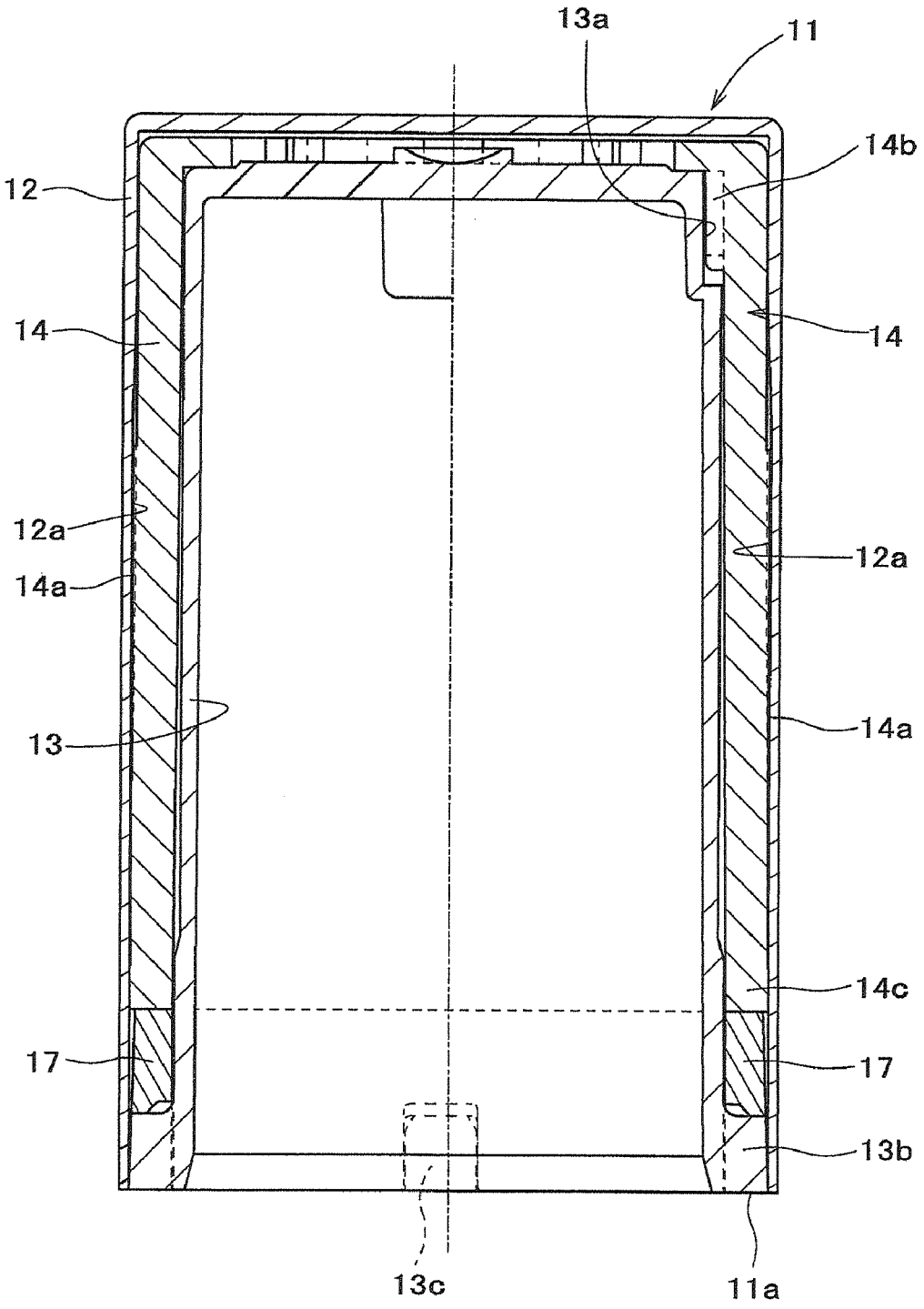
FIG. 3 is a longitudinal sectional view of the cap.

A cosmetic container in accordance with the invention is identified by the letter X in FIGS. 1 to 3. The cosmetic container X has a container body 1 that includes a bottom cover 2 making up a bottom surface, and a tubular petticoat cylinder 3 making up a side surface of the container body 1, that rotates integrally with the bottom cover 2, and at an inner circumferential surface side of the petticoat cylinder 3. A tubular gripping cylinder 4 is assembled rotatably along a longitudinal axis with respect to the bottom cover 2 and the petticoat cylinder 3.

First engaging protrusions 2*a* are formed at an upper surface side of the bottom cover 2 and engage with the petticoat cylinder 3, The first engaging protrusions 2*a* oppose each other and are engaged with a pair of notches 3*b* formed at a lower side of the petticoat cylinder 3 Thus, the bottom cover 2 and the petticoat cylinder 3 can rotate integrally. Also, a tubular middle cylinder 5 is disposed at the inner circumferential surface side of the petticoat cylinder 3. Ribs 5*a* are formed at an inner circumferential surface side of a lower half portion of the middle cylinder 5. The ribs 5*a* engage with a second engaging protrusion 2*b* formed on the bottom cover 2 so that the bottom cover 2 and the middle cylinder 5 are made to rotate integrally. A tubular-bottomed body cylinder 6 is fit internally to an inner circumferential surface side of an upper half portion of the middle cylinder 5. An opening portion 6*a* is formed to open at a central position of at a bottom portion of the body cylinder 6. Convex ribs 6*b* are formed on an inner wall of the opening portion 6*a* and engage with a third engaging protrusion 2*c* that protrudes from a central portion of the upper surface of the bottom cover 2 so that the bottom cover 2 and the body cylinder 6 rotate integrally. The bottom cover 2, the petticoat cylinder 3, the middle cylinder 5, and the body cylinder 6 thus mutually engaged and are made integral so as not to rotate individually about an axial center (longitudinal axis).

A weight 7 provides a suitable weight sensation to the container body and adds a sense of vertical direction to the container X.

Two guide holes 6*c* are carved opposite each other in the body cylinder 6 and are line-like in the longitudinal direction of the container body 1. A spiral cylinder 8, is disposed between the body cylinder 6 and the gripping cylinder 4 and rotates integrally with the gripping cylinder 4. A spiral groove 8*a* is carved in the spiral cylinder 8. Protrusions 9*a*, projecting from both ends of a middle plate 9, in which a cosmetic is stored, and are engaged respectively with the guide holes 6*c* and the spiral groove 8*a* so that when the gripping cylinder 4 is rotated relatively with respect to the petticoat cylinder 3 along the longitudinal axis. The protrusions 9*a* of the middle plate 9 are guided slidingly by the spiral groove 8*a* while being rotation-controlled by the guide holes 6*c*, and the middle plate 9 thereby is made to move vertically inside the body cylinder 6 while being rotation-controlled with respect to the petticoat cylinder 3.

A ring 10 is disposed between the middle cylinder 5 and the body cylinder 6, and is engaged with the body cylinder 6 so as to rotate relatively with the body cylinder 6. In other words, the ring 10 functions to support the spiral cylinder 8 from the bottom to maintain the spiral cylinder 8 at a predetermined position during incorporation of the spiral cylinder 8 and during use of the cosmetic container.

A cap 11 is fit externally to the container body 1. The cap 11 includes a cap body 12 with a tubular-topped form and an inner cap 13 with a tubular-topped form that is lockingly attached to an inner side of the cap body 12. A spacer 14 is incorporated between the cap body 12 and the inner cap 13 to fill a gap.

Four recessed grooves 12*a* are formed in the longitudinal direction at equal intervals in an inner circumferential surface of the cap body 12. Four protrusions 14*a*, fitting with the recessed grooves 12*a*, are formed in the longitudinal direction in likewise manner as the recessed grooves 12*a* on an outer circumferential surface of the spacer 14 that contacts the inner circumferential surface of the cap body 12. The spacer 14, thus, is incorporated while being aligned with respect to the cap body 12. Further, a convex portion 14*b* protrudes at an upper side of the inner circumferential surface of the spacer 14 and engages with and is incorporated in a recessed portion 13*a* formed at an upper side of an outer circumferential surface of the inner cap 13.

Figure 4A:
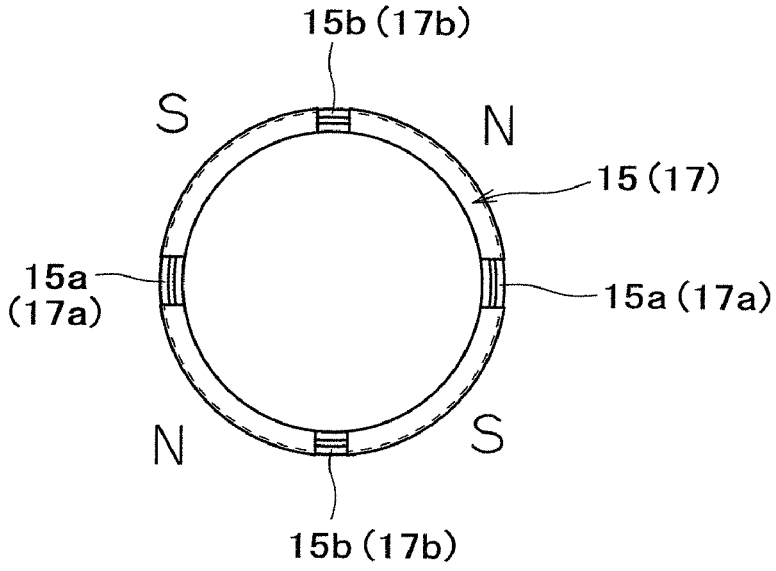
FIGS. 4A, 4B, 4C are, respectively, a front view, a side view, and a rear view of first and second magnets.
Figure 4B:
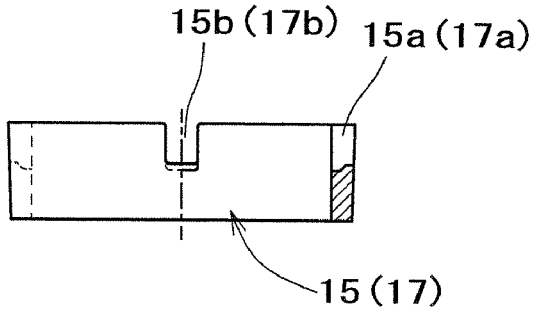
Figure 4C:
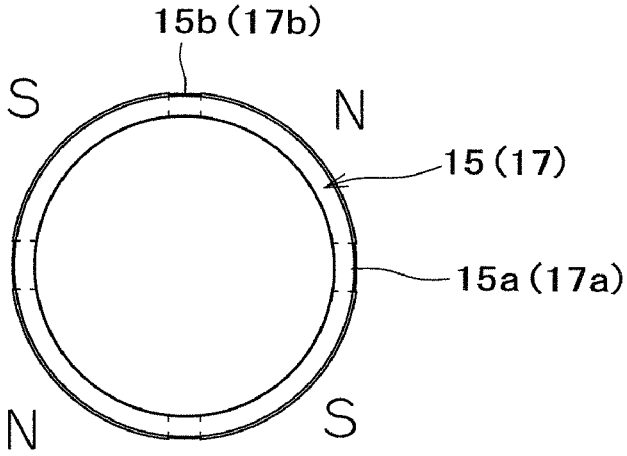

With the cosmetic container X arranged as described above, first and second magnets 15 and 17 are disposed respectively at an upper end 1*a* of the container body 1 and a lower end 11*a* of the cap 11. More particularly, the tubular first magnet 15 is sandwiched between the petticoat cylinder 3 and the middle cylinder 5 of the container body 1. The first magnet 15 is fit externally to the middle cylinder 5 from the upper side and a lower surface thereof and is supported in contact with a collar 5*b* disposed at an outer circumferential surface of an upper end of the middle cylinder 5. As shown in FIG. 4, first and second notches 15*a* and 15*b* of two different groove widths are formed alternately at 90-degree angular intervals at an upper portion of the first magnet 15.

Figure 5:
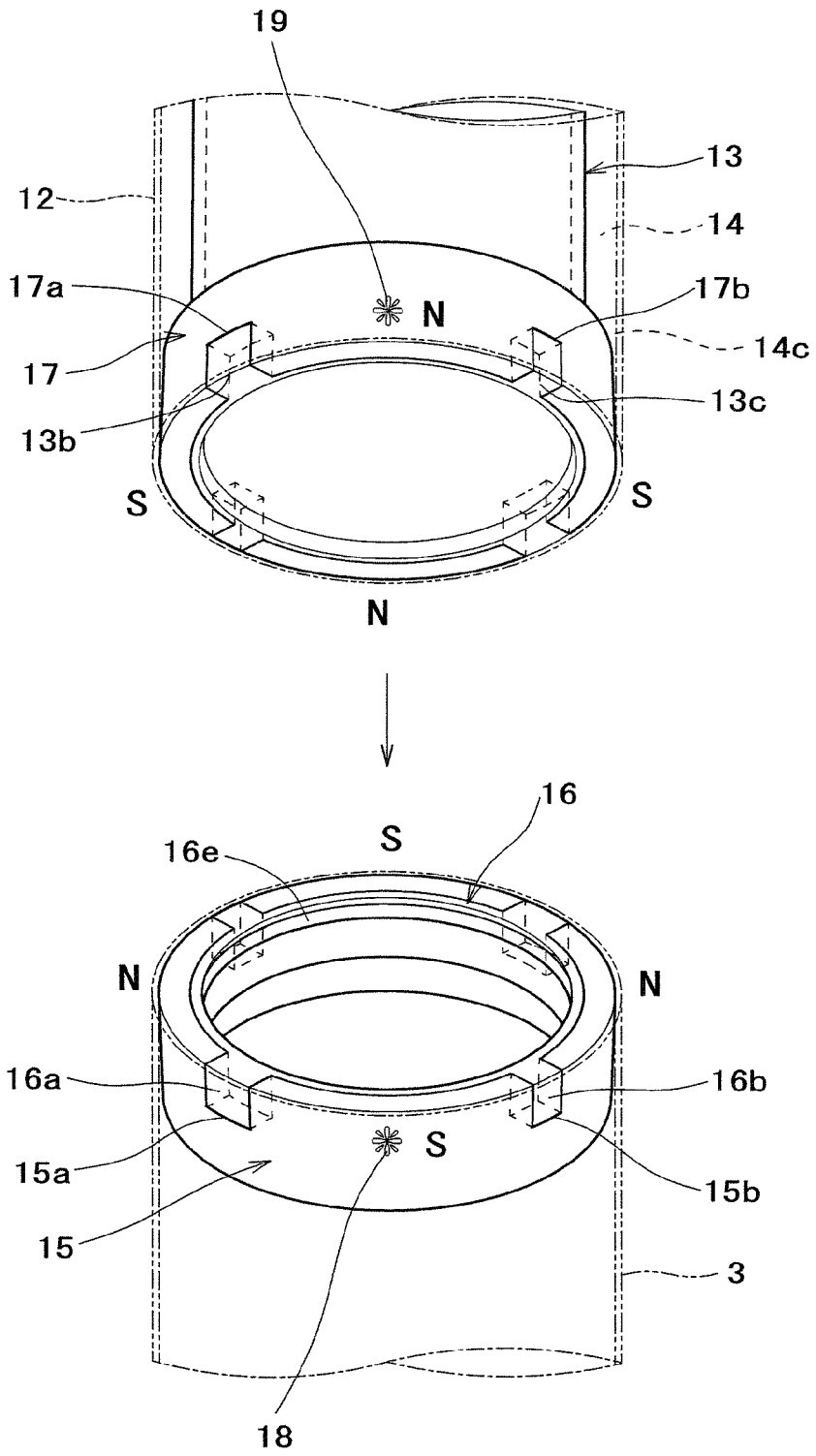
FIG. 5 is an explanatory diagram of a first embodiment showing a manner in which a first magnet and a second magnet, each having four poles, are magnetically attached.

As shown in FIG. 5, a presser 16 is fit externally to the middle cylinder 5 from above and presses the externally fit first magnet 15 from the above. The presser 16 is tubular and has a ring-like convex portion 16*e* formed on an inner circumferential surface that engages a recess 5*c* formed on the outer circumferential surface of the upper end of the middle cylinder 5 in a correctly positioned state. First and second protrusions 16*a* and 16*b* protrude from an outer circumferential surface of the presser 16 and fit respectively with the first and second notches 15*a* and 15*b* of the first magnet 15 in the correctly positioned state.

The second magnet 17 has the same shape as the first magnet 15 and is disposed at the lower end 11*a* of the cap 11 that contacts the container body 1 in a container body covering state. The second magnet 17 is sandwiched by first and second positioning protrusions 13*b* and 13*c* provided on an outer circumference of the inner cap 13 and a lower end 14*c* of the spacer 14. The second magnet 17 is upside-down with respect the first magnet 15 so that magnetic poles that differ from the magnetic poles of the first magnet 15 in the container body 1 face the container body. The second magnet 17 is installed so that the first and second protrusions 13*b* and 13*c* formed on the inner cap 13 fit from the lower side into third notches 17*a* and fourth notches 17*b* formed in the second magnet 17. Accordingly, circumferential rotation and dropping of the second magnet 17 are prevented.

The first and second magnets 15 and 17 are bonded magnets made of a neodymium magnet as a magnetic material and are four-pole magnets in which S poles and N poles are disposed alternately in a tubular circumferential direction. The magnets 15 and 17 are set so that the poles differ across the respective notches 15*a*, 15*b*, 17*a*, and 17*b*. Thus at the portion at which the container body 1 and the cap 11 contact, an S pole and an N pole are in mutually opposing positions across each of the first and second protrusions 16*a* and 16*b* of the presser 16 as partitions.

The cap 11 is fit on the container body 1 from above so that the first magnet 15 and the second magnet 17 gradually approach each other. The first and second magnets 15 and 17 attract each other after a certain degree of fitting is achieved. The magnets become magnetically attached to each other in a final stage and make a snapping sound when the cap 11 is put in a fully covering posture.

Figure 6A:
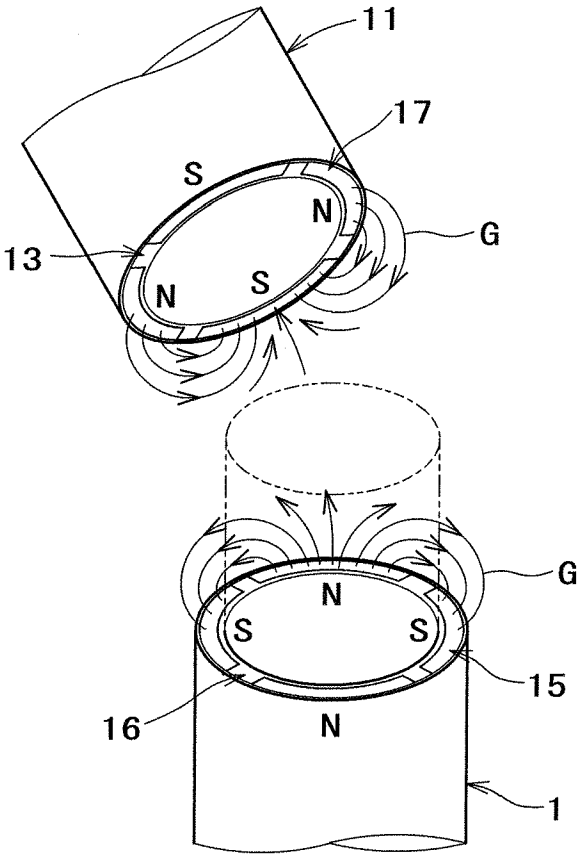
FIGS. 6A, 6B, 6C are, respectively, action diagrams showing a manner in which the cap is made to cover the container body.
Figure 6B:
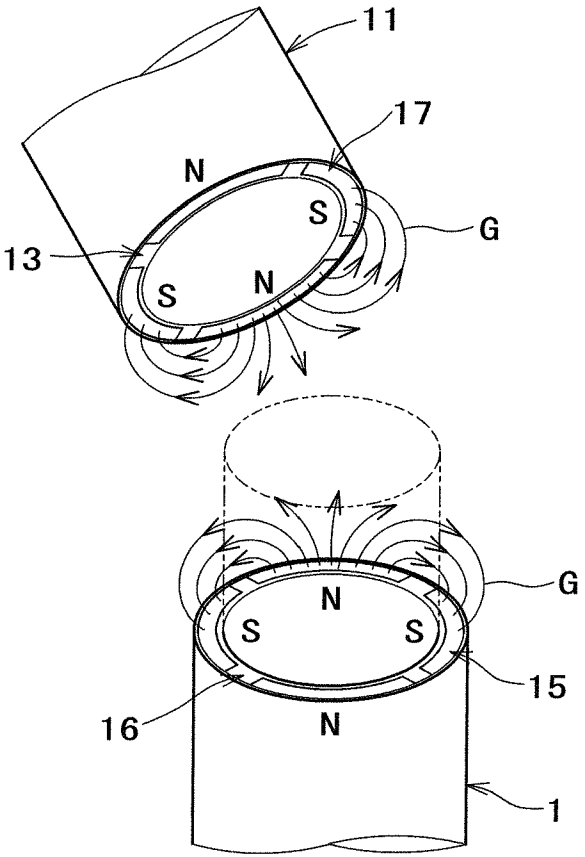
Figure 6C:
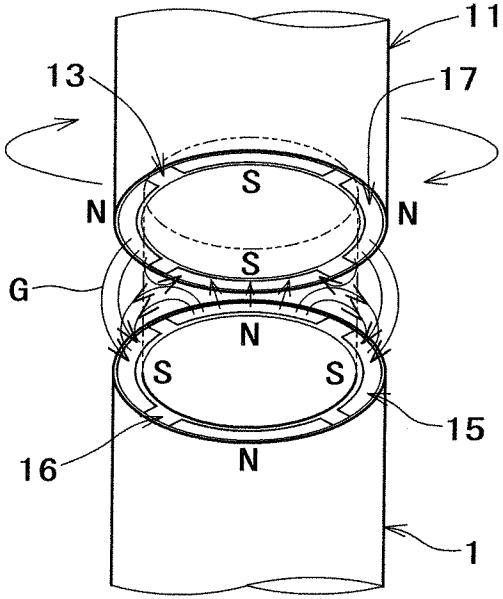

Each of the first magnet 15 and the second magnet 17 generates a magnetic field in the circumferential direction as shown in FIG. 6A. Covering can be performed in a substantially aligned state where the S poles of the second magnet 17 in the cap 11 approximately oppose the N poles of the first magnet 15 in the container body 1. Thus, the first and second magnets 15 and 17 attract each other, and covering of the container body 1 by the cap 11 is achieved smoothly in a state where the cap 11 does not rotate or rotates slightly. On the other hand, covering may be performed in a repulsive state where the N poles of the second magnet 17 oppose the N poles of the first magnet 15 as shown in FIG. 6B. In this situation, the N poles of the second magnet 17 repel the N poles of the first magnet 15. However, a rotating force tends to make the N poles rotate in the circumferential direction along magnetic lines G and approach the S poles. Thus, the cap 11 undergoes smooth rotation in the circumferential direction with respect to the container body 1, and the first magnet 15 and the second magnet 17 enter a state where mutually different poles oppose each other, as shown in FIG. 6C, so that covering is achieved.

Figure 7C:
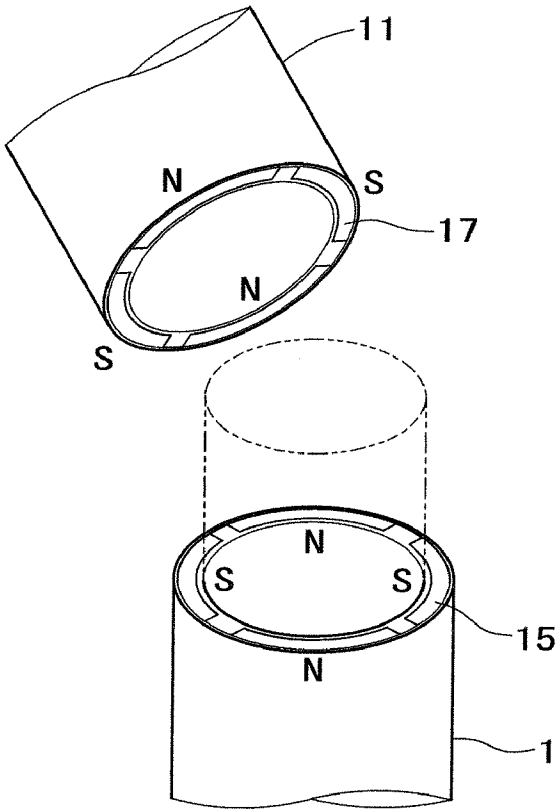
FIGS. 7A, 7B, 7C are, respectively, action diagrams showing a manner in which the cap is removed from the container body.
Figure 7B:
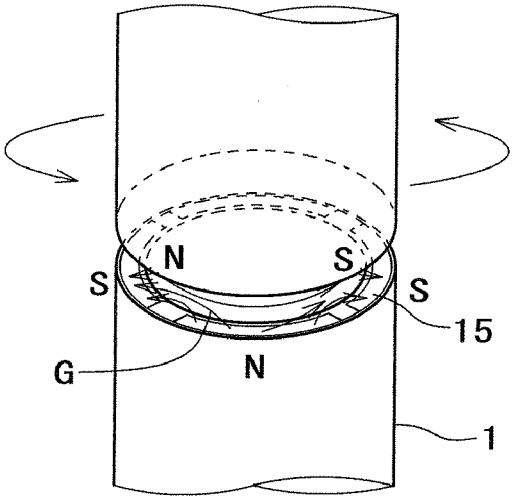
Figure 7A:
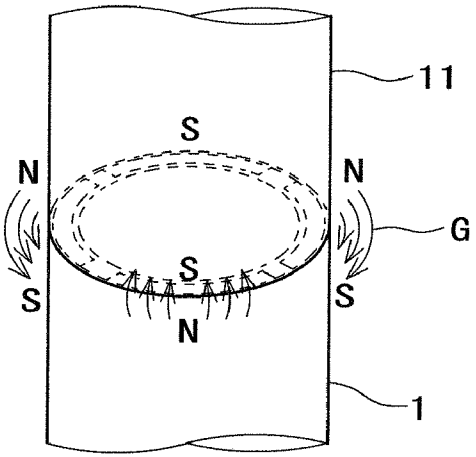

The cap 11 periodically must be removed from the container body 1. However, the first magnet 15 and the second magnet 17 are in a state of being magnetically attached firmly, as shown in FIG. 7A, and a strong force in a direction of severing the magnetic lines G is required to pull off the cap 11 axially from the container body 1. However, the cap 11 can be rotated in the circumferential direction of the container body 1, as shown in FIG. 7B, along the magnetic lines G of the first and second magnets 15 and 17. A smooth rotation can be achieved in a natural manner without a jolt sensation. Rotation by substantially 90 degrees causes a repulsive force to act due to the same poles opposing each other, as shown in FIG. 7C, so that a smooth removal can be performed using this repulsive force and the removal work is made smooth and easy.

Magnetic attractive forces of the first and second magnets 15 and 17 are used to cover the cosmetic container X with the cap 11. Thus, the cap 11 is put in a most strongly locked state in the completely covered condition. Stability is provided in the covered state, and the completely covered condition of the cap can be recognized. Consequently, there is no need to provide a rib at the container body side as in the prior art, and the container body 1 that is exposed when the cap 11 is removed can have a neat form. The covering of the container body 1 by the cap 11 is assisted or performed by magnetic force, and there is thus no need to push forcibly to make a thick-walled portion on the cap pass over a rib on the container body as in the prior art. Full covering can be accomplished in a semiautomatic manner simply beginning to cover the container body 1 with the cap 11 with a light manual force. The magnetic attractive force then supplements the light manual force to complete the covering in a highly efficient manner.

Each of the first and second magnets 15 and 17 has a ring-like form with a plurality of magnetic poles. Thus, rectilinear magnetic lines are generated between the first and second magnets 15 and 17 as well as circular-arc magnetic lines between adjacent different poles in each of the first and second magnets 15 and 17 when the cap 11 is covering the container body 1 is covered with the cap 11. These circular-arc magnetic lines act as a magnetic force in a direction of rotating the cap 11 with respect to the container body 1. Thus, lightly covering the container body 1 with the cap 11 causes the cap to rotate automatically so that the different poles of the first and second magnets 15 and 17 become magnetically attached to each other and the fully covering posture is reached. In the removing process, the cap 11 is rotated with respect to the container body 1, thereby making the same poles of the first and second magnets 15 and 17 approach each other. The cap 11 then can be removed using the mutual repulsive force of the same poles. Moreover, the transition from the magnetically attached state to the repulsive state in the process of removal is achieved along the circular-arc magnetic lines G that are generated between the different poles in each of the first and second magnets 15 and 17. Thus, the transition is achieved smoothly. An uncomfortable jolt sensation due to sudden transition is not generated, and the cap 11 can be removed smoothly.

Neodymium magnets are described above. However, the magnets are not restricted thereto and may, for example, be samarium magnets or other rare earth magnets, and further obviously, ferrite-based magnets may be used as well.

Four-pole magnets are described above as being disposed in the cap and the container body. However, the magnets are not restricted thereto and may be two-pole magnets as in a second embodiment shown in FIG. 8, and may obviously have multiple poles of other numbers. Obviously even in this case, the magnetic lines G are generated between different poles that are adjacent in each of the first and second magnets 15 and 17 and thus the same actions as those described above arise during covering and removal.

Figure 8:
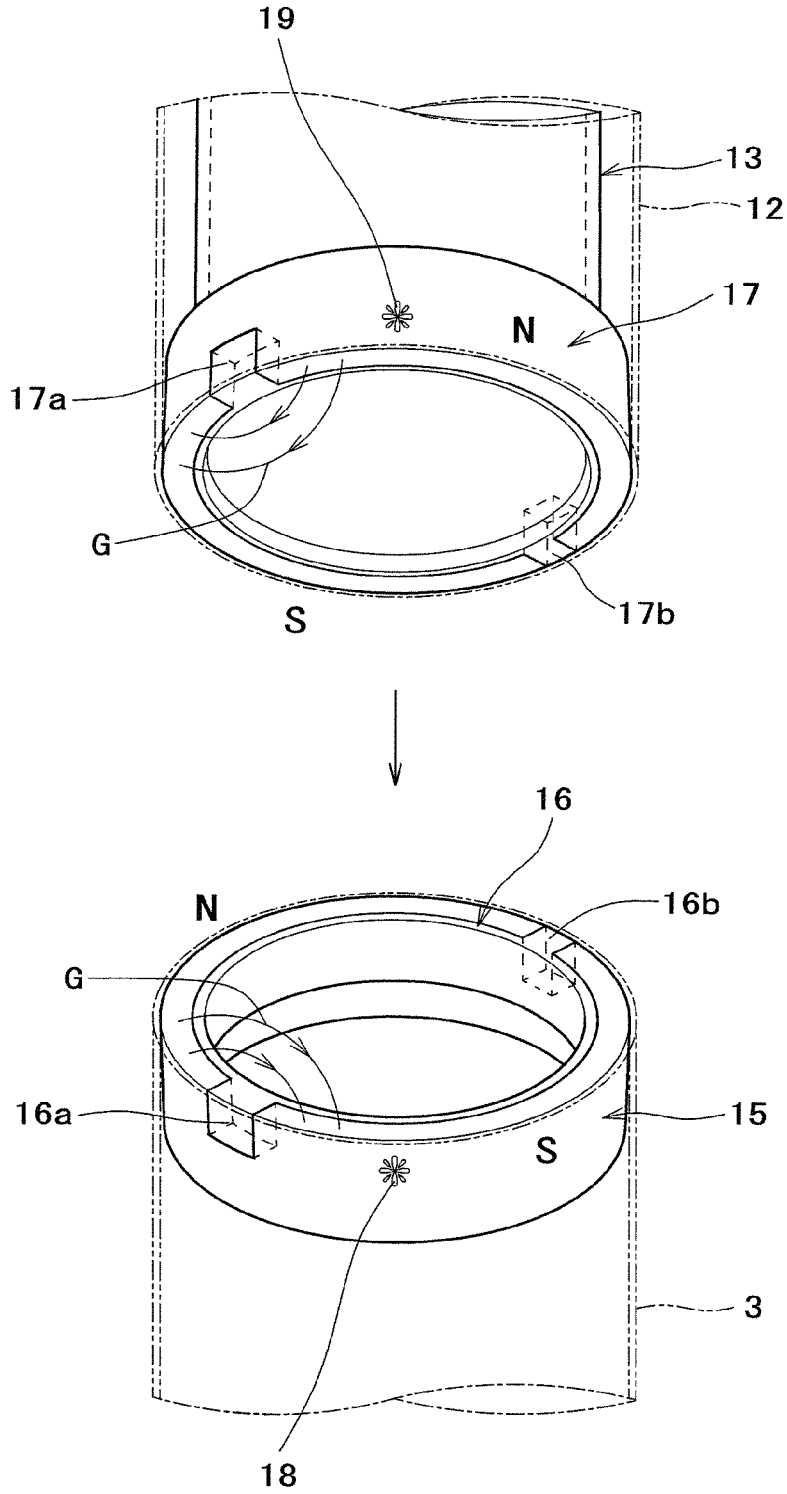
FIG. 8 is an explanatory diagram of a second embodiment showing a state in which a first magnet and a second magnet, each having two poles, are incorporated.

As shown in FIG. 5 and FIG. 8, marks 18 and 19 may be provided at outer circumferences of the container body 1 and the cap 11 so that when the cap 11 is fit onto the container body 1, covering can be performed in a position in which mutually different poles become magnetically attached to each other. This arrangement enables fitting in a manner so that the same poles will not oppose each other in the covering process, and the cosmetic container is even more easily coverable.

Figure 9:
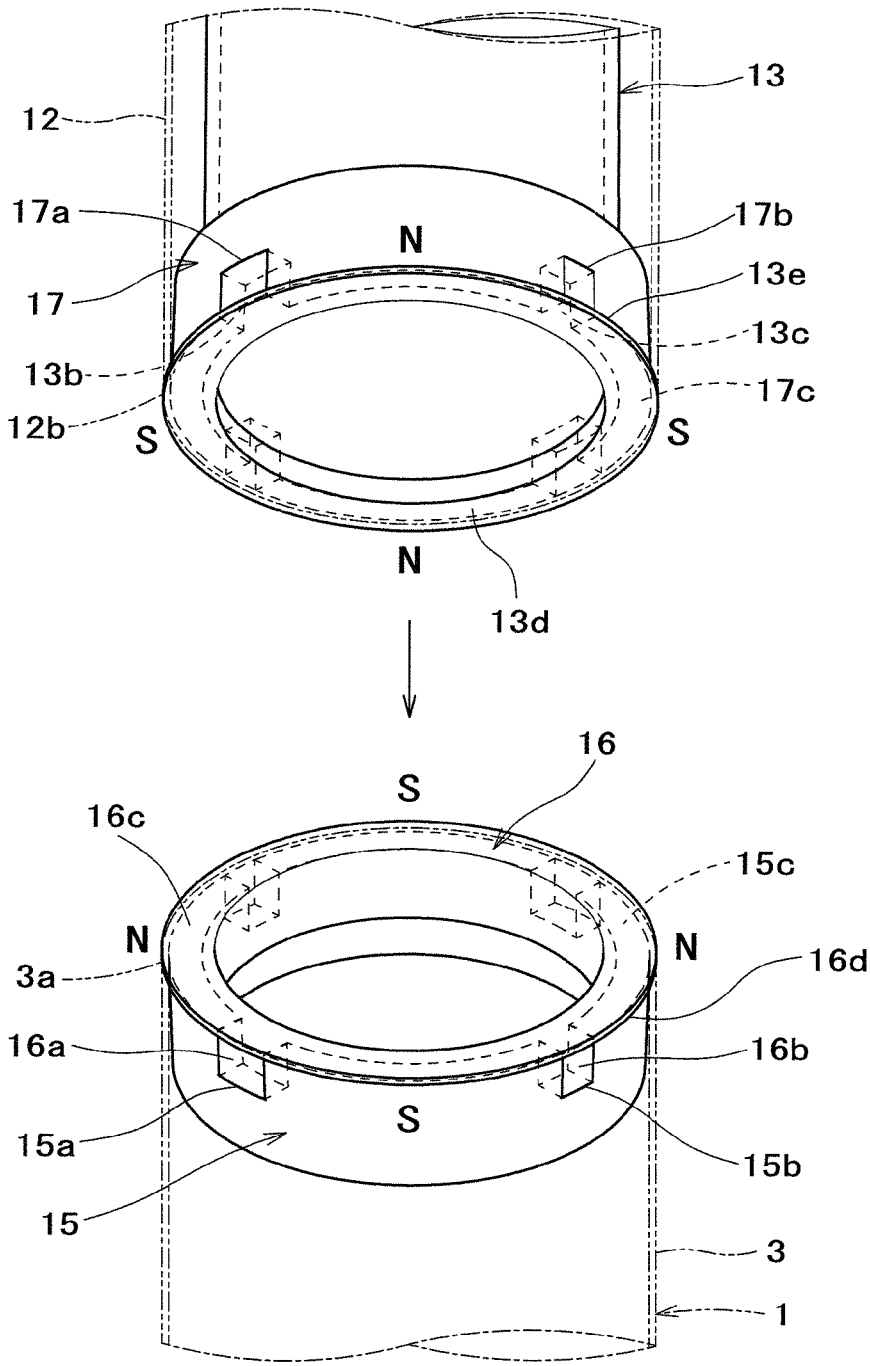
FIG. 9 is an explanatory diagram of a third embodiment showing a state in which a first magnet and a second magnet, each having four poles, are incorporated in a covered manner.
Figure 10:
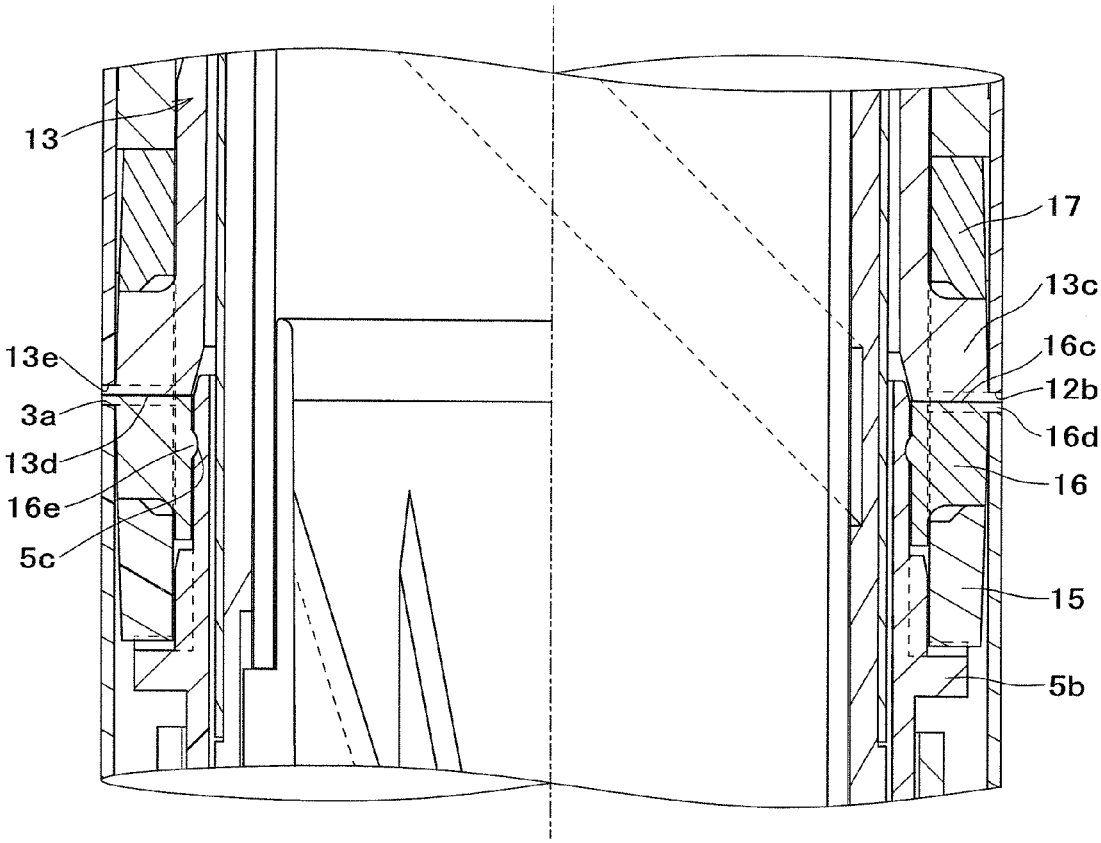
FIG. 10 is a longitudinal sectional view of principal portions showing a state where a container body of the third embodiment is fully covered by a cap.

A third embodiment is shown in FIG. 9 and FIG. 10 and employs four-pole magnets. With this embodiment, mutually abutting surfaces (magnetically attached surfaces) of the first and second magnets 15 and 17 are covered completely and are not visibly recognizable from the exterior.

With this embodiment, a flange 16*c* that projects in the outer circumferential direction at an upper side surface of the presser 16 so as to cover an upper side surface 15*c* of the first magnet 15. An outer end 16*d* of the flange 16*c* defines a larger diameter than an outer diameter of the first magnet 15 and is equal to the outer diameter at an upper end 3*a* of the petticoat cylinder 3. In a state where the first magnet 15 is lockingly installed in the container body 1 via the presser 16, the outer end 16*d* of the flange 16*c* abuts the upper end 3*a* of the petticoat cylinder 3 from above so that a completely covered condition is achieved in which even the surface of the first magnet 15 that is abutted against the second magnet 17 is covered.

On the other hand, in a manner similar to the presser 16, a flange 13*d* is formed on the lower end of the inner cap 13 that is installed in the cap body 12 and projects in the outer diameter direction to cover a lower surface 17*c* of the second magnet 17. An outer end 13*e* of the flange 13*d* is larger in diameter than an outer diameter of the second magnet 17 and is equal in outer diameter to a lower end 12*b* of the cap body 12. The outer end 13*e* of the flange 13*d* abuts the lower end 12*b* of the cap body 12 from below when the second magnet 17 is fit externally and installed in the inner cap 13, so that even the surface of the second magnet 17 that abuts against the first magnet 15 is covered.

Thus when the cap 11 covers the container body 1, the outer end 16*d* of the presser 16 and the outer end 13*e* of the inner cap 13 appear in a double-ring-like manner in a mutually abutted state between the container body 1 and the cap 11, as shown in FIG. 10.

By the above arrangement, the first and second magnets 15 and 17 are put in completely covered conditions and are not visibly recognizable from the exterior when the cap 11 covers the container body 1 and also when the cap is removed. Thus, the cosmetic container can be beautiful and the magnets are not visibly recognizable even during use. In addition, the first and second magnets 15 and 17 are not likely to break upon hitting a foreign object, and even if a magnet becomes broken, the magnet does not become lost from the container body 1 or the cap 11.

Figure 11:
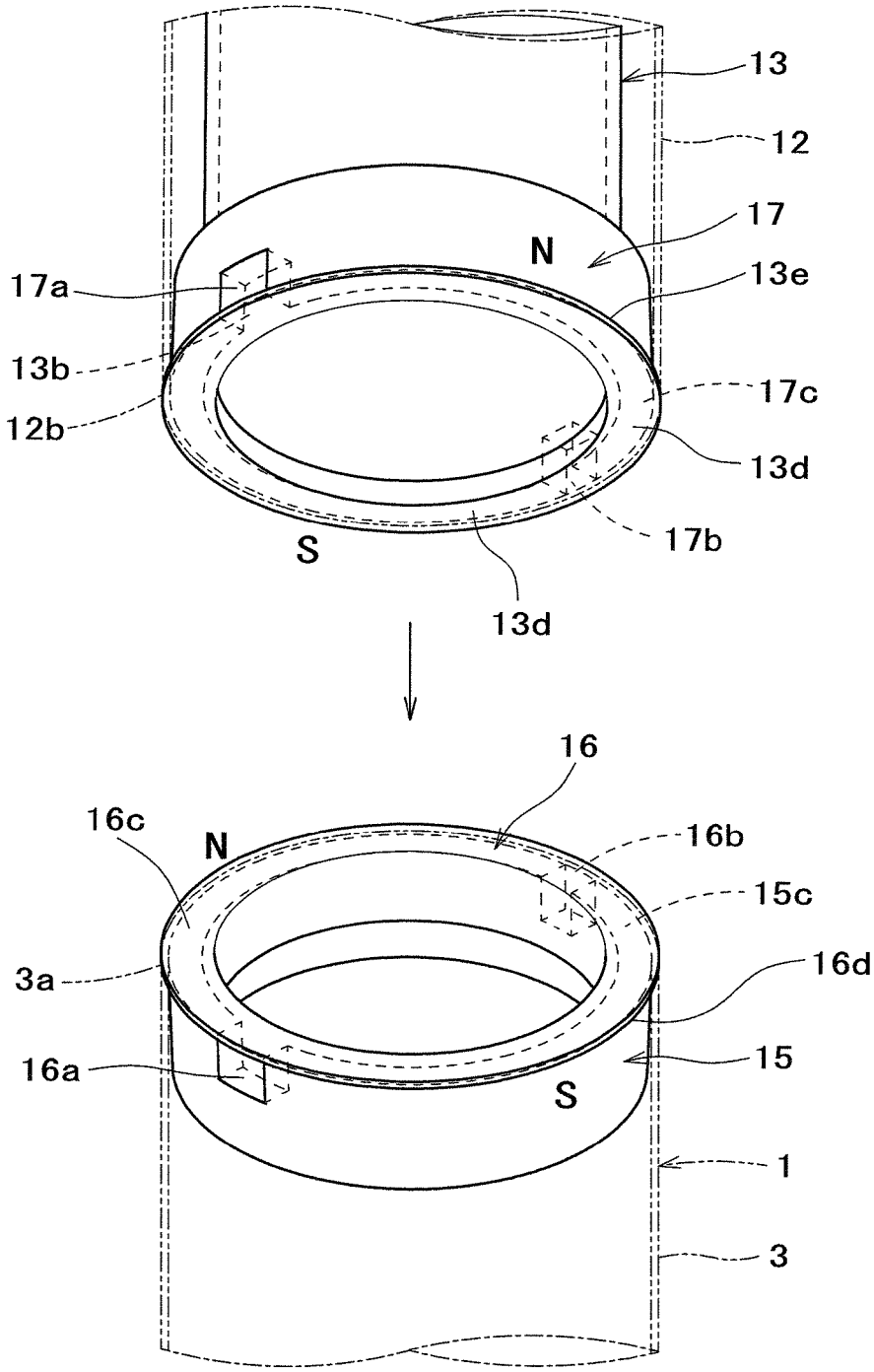
FIG. 11 is an explanatory diagram of a fourth embodiment showing a state in which a first magnet and a second magnet, each having two poles, are incorporated in a covered manner.

Full covering of the magnets 15 and 17 can be applied in likewise manner even to an arrangement employing two-pole magnets as in a fourth embodiment shown in FIG. 11. Reference symbols of FIG. 11 are the same as those of the third embodiment shown in FIG. 9, and these are thus provided with the same reference symbols and detailed description thereof shall be omitted.

Figure 12:
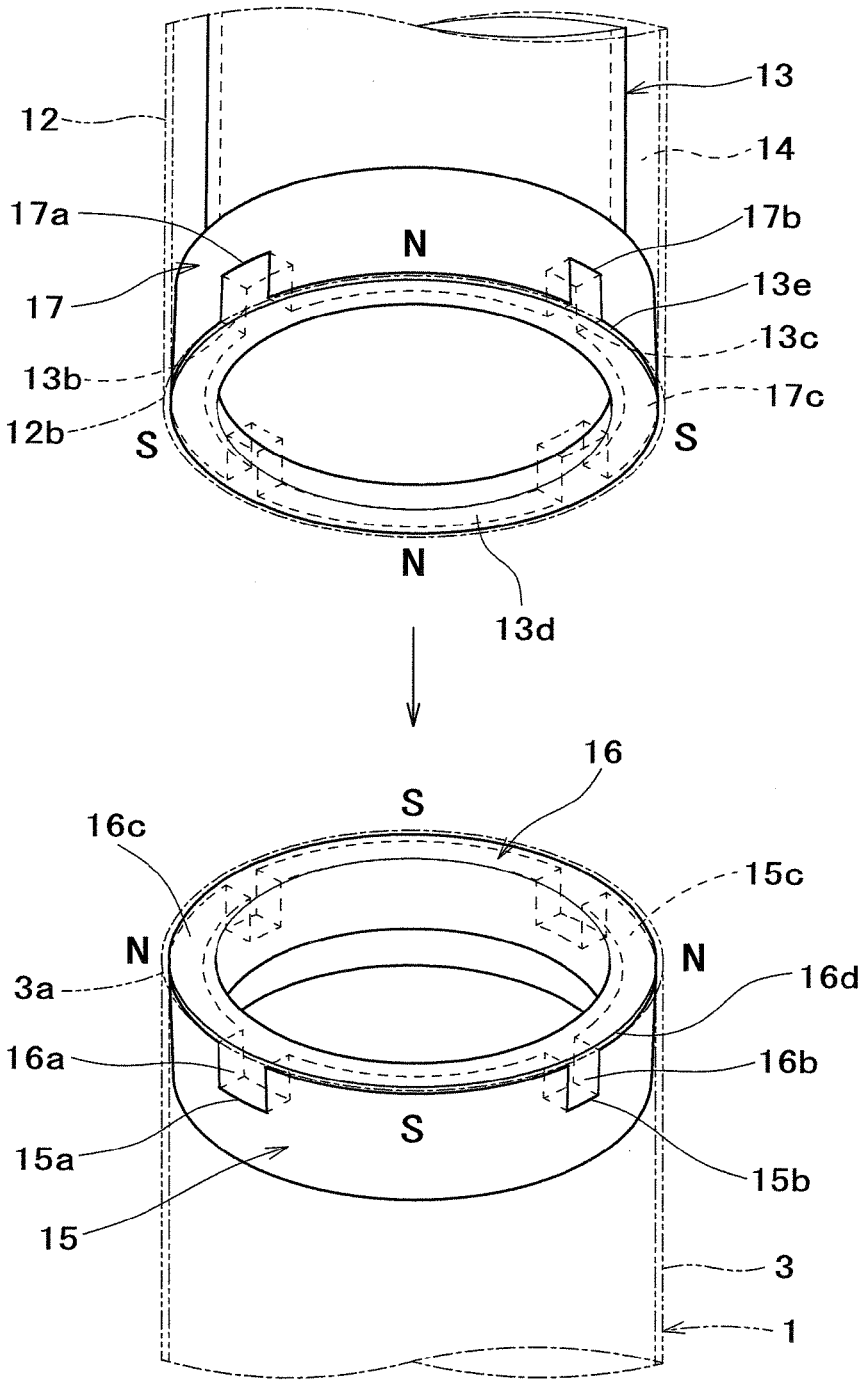
FIG. 12 is an explanatory diagram of a fifth embodiment showing a state in which a first magnet and a second magnet, each having four poles, are incorporated in a covered manner.
Figure 13:
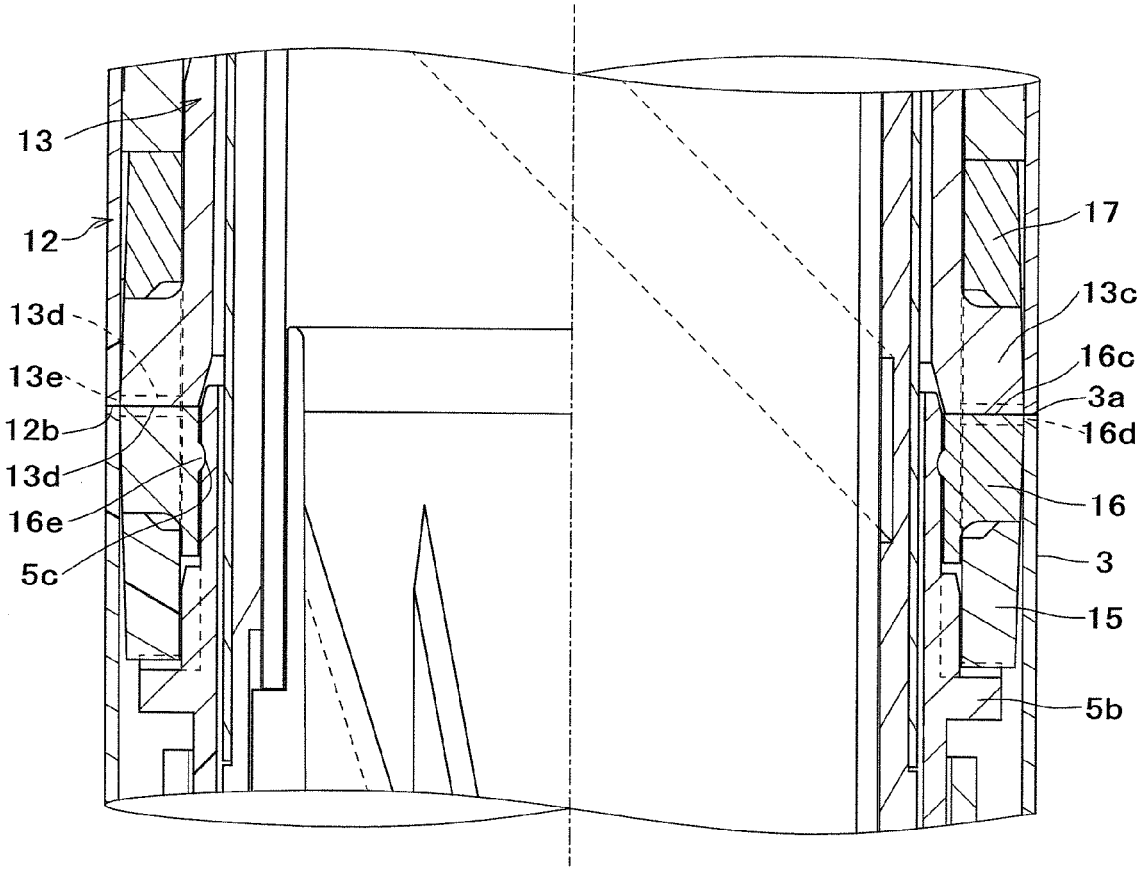
FIG. 13 is a longitudinal sectional view of principal portions showing a state where a container body of the fifth embodiment is fully covered by a cap.
Figure 14:
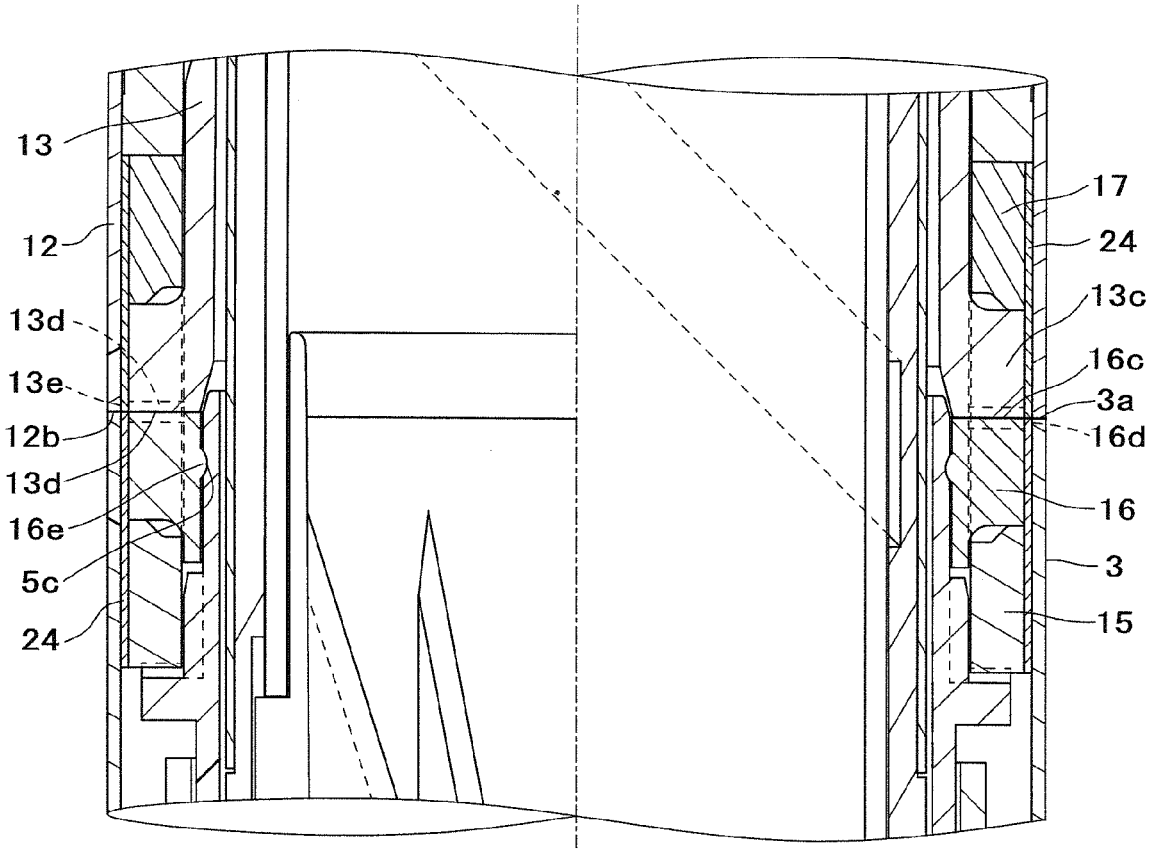
FIG. 14 is a longitudinal sectional view of principal portions of a sixth embodiment showing a state where magnetic line shielding members are incorporated in a cosmetic container.
Figure 15:
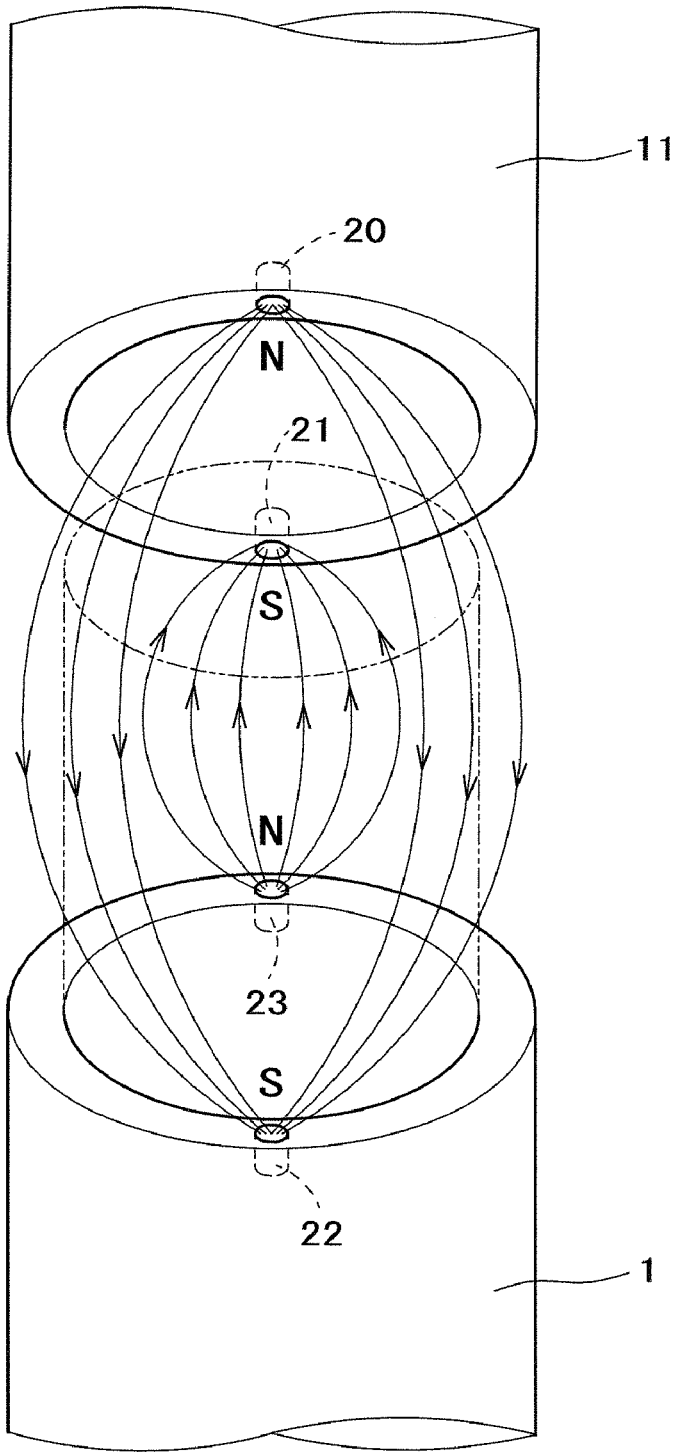
FIG. 15 is an action diagram of a state of magnetic lines in a case where magnets are disposed in a dotted manner at contacting surfaces of a cap and a container body.

The magnets 15 and 17 may be covered fully as in a fifth embodiment shown in FIGS. 12 and 13. Although a case of using four-pole magnets is illustrated here, the same can be applied to two-pole magnets.

With this embodiment, outer diameters of the respective flanges 16*c* and 13*d* of the presser 16 and the inner cap 13 are equal to the outer diameters of the first and second magnets 15 and 17. Additionally, the petticoat cylinder 3 and the cap body 12 are extended to positions of fitting externally to the flanges 16*c* and 13*d* so that the mutually extended ends contact each other in the cap covering state. In this case, as shown in FIG. 13, the petticoat cylinder 3 and the cap body 12 mutually abut when the cap covers the container body 1 despite the magnets 15 and 17 being covered completely.

Magnetic line shielding members formed of a solitarily ferromagnetic material, such as iron or cobalt, etc., or formed of an alloy including these materials, may be fit externally to outer circumferential surfaces of the first and second magnets to prevent or reduce leakage of magnetic forces of the first and second magnets from the cosmetic container. By this arrangement, the magnetic forces of the first and second magnets can be prevented from influencing a magnetic body, etc., close to the exterior of the cosmetic container X, and the cosmetic container can be stored in a handbag, etc., without worry.

Although in the present embodiment, the magnetically attached positions of the magnets are set at the lower end of the cap 11 and the container body position that contacts the lower end, the magnets are not restricted thereto and may be arranged at an intermediate position or an upper end position of the cap and at container body positions that oppose these positions.

The present invention can be applied to cosmetic containers that store such cosmetics as lipstick.

What is claimed is:

1. A cosmetic container comprising:

a tubular-bottomed container body storing a cosmetic;

a tubular-topped cap externally fit in a removable manner from an upper end of the container body to fully cover a to-be-covered portion at an upper end of the container body to define a full covered condition;

first magnets disposed in the container body and second magnets disposed in the cap so that the first and second magnets are opposed to each other in the full covered condition; and the first and second magnets respectively being formed into rings in a circumferential direction and having a plurality of magnetic poles disposed alternately in the circumferential direction, the first and second magnets being attached to each other in the full covered condition;

marks are provided at outer circumferences of the container body and the cap for positioning the cap to the container body so that covering is performed in a position in which different poles of the first magnets and the second magnets are aligned and magnetically attached to each other in the full covered condition, a presser fit integrally to the container body and having first and second protrusions, an inner cap fit integrally to the cap and having first and second protrusions, first notches and second notches formed alternately in the circumferential direction of the first and second magnets and having different groove widths, wherein:

the first and second magnets have different poles set across the respective notches, the first and second notches of the first magnets are fit to the first and second protrusions formed in the presser, the first and second notches of the second magnets are fit to the first and second protrusions formed in the inner cap, whereby the first magnets and the second magnets attached to each other when the marks of the container body and the cap align in the full covering condition.

2. The cosmetic container of claim 1, wherein the magnets of the cap is at a lower end of the cap, and the magnets of the container body is disposed at a portion contacting the lower end of the cap in the completely covered condition.

3. The cosmetic container of claim 1, wherein each of the magnets has four magnetic poles.

4. The cosmetic container of claim 1, wherein each of the magnets has two magnetic poles.

5. The cosmetic container of claim 1, wherein the cap and the container body are provided with covering members covering the magnets so that the magnets are not exposed.

6. The cosmetic container of claim 1, wherein the cap and the container body are provided with magnetic line shielding members for shielding or reducing leakage of magnetic lines from the magnets.

* * * * *